US008556384B2

(12) United States Patent
Ohno et al.

(10) Patent No.: US 8,556,384 B2
(45) Date of Patent: Oct. 15, 2013

(54) DROPLET EJECTION HEAD AND A METHOD FOR MANUFACTURING DROPLET EJECTION HEAD

(75) Inventors: Kenichi Ohno, Kanagawa (JP); Torahiko Kanda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/546,294

(22) Filed: Jul. 11, 2012

(65) Prior Publication Data

US 2013/0241998 A1 Sep. 19, 2013

(30) Foreign Application Priority Data

Mar. 16, 2012 (JP) ..... 2012-060717

(51) Int. Cl.
*B41J 23/00* (2006.01)

(52) U.S. Cl.
USPC ..... 347/47

(58) Field of Classification Search
USPC ..... 347/42, 49, 47
See application file for complete search history.

(56) References Cited

U.S. PATENT DOCUMENTS

| | | | | |
|---|---|---|---|---|
| 7,299,865 | B1 * | 11/2007 | Kocher | 166/85.2 |
| 8,042,919 | B2 * | 10/2011 | Lim et al. | 347/70 |
| 2001/0024217 | A1 | 9/2001 | Kanda et al. | |
| 2008/0284826 | A1 | 11/2008 | Owaki et al. | |

FOREIGN PATENT DOCUMENTS

| | | |
|---|---|---|
| JP | 2001-260366 | 9/2001 |
| JP | 2008-284724 | 11/2008 |
| JP | 2011-079272 | 4/2011 |

OTHER PUBLICATIONS

Machine Tranlation in English of Japanese Application No. 2011-079272; dated Apr. 21, 2011.

* cited by examiner

*Primary Examiner* — Lamson Nguyen
(74) *Attorney, Agent, or Firm* — Fildes Outland, P.C.

(57) ABSTRACT

A droplet ejection head includes head members, dummy members, a sealant, and elastic members. Each of the head members has a nozzle face where a plurality of nozzles for ejecting droplets are formed and an attaching face which is a back side face with respect to the nozzle face. Each of the dummy members has a dummy nozzle face and an attaching face which is a back side face with respect to the dummy nozzle face. The dummy members are placed at both end sides of the elongated substrate in the longitudinal direction so that second gaps between the outmost head members and the dummy members are formed. The sealant is filled in each of first gaps between the head members and the second gaps, bonds the head members and the dummy members with the outmost head members, and seals the first gaps and the second gaps.

9 Claims, 13 Drawing Sheets

32
60
32A
35
48
36

32
U
35
60
48
32A
36
49

32
U
35
60
48
32A
36

32
60
U
32A
35
48
36

35
U
32
60
32A
36

DROPLET EJECTION HEAD AND A METHOD FOR MANUFACTURING DROPLET EJECTION HEAD

CROSS-REFERENCE TO RELATED APPLICATIONS

This application is based upon and claims priority under 35 USC 119 from Japanese Patent Application No. 2012-060717, filed Mar. 16, 2012.

BACKGROUND

Technical Field

The present invention relates to a droplet ejection head and a method for manufacturing the droplet ejection head.

SUMMARY OF THE INVENTION

According to an aspect of the invention, a droplet ejection head includes a plurality of head members, plurality of dummy members, a sealant, and a plurality of elastic members. Each of the head members has a nozzle face where a plurality of nozzles for ejecting droplets are formed and an attaching face which is a back side face with respect to the nozzle face. The head members are arranged at a predetermined interval in a longitudinal direction of an elongated substrate by attaching the attachment faces to the elongated substrate. Each of the plurality of dummy members has a dummy nozzle face and an attaching face which is a back side face with respect to the dummy nozzle face. The dummy members are placed at both end sides of the elongated substrate in the longitudinal direction so that second gaps between the outmost head members and the dummy members are formed. The sealant is filled in each of first gaps between the head members and the second gaps, bonds the head members with each other and the dummy members with the outmost head members, and seals the first gaps and the second gaps. The plurality of elastic members are disposed in the first gaps and the second gaps, and prevent the sealant from leaking to the attachment face of the head member and the nozzle face from the first gaps and the second gaps before the sealant solidifies.

BRIEF DESCRIPTION OF THE DRAWINGS

Exemplary embodiments of the invention will be described in detail based on the following figures, wherein.

DETAILED DESCRIPTION

Exemplary embodiments of the present invention will be described hereafter in detail with reference to the drawings. Meanwhile, it is assumed that, for the convenience of description, the arrow 'UP' illustrated in FIG. 2 indicates the upward direction of an inkjet recording head 30, an example of a droplet ejection head, the arrow 'X' indicates the paper-conveying direction, and the arrow 'Y' indicates the paper's width direction perpendicular to the paper-conveying direction. A summary of an inkjet recording apparatus 10 that is an example of a droplet ejection apparatus will be described first.

Figure 1:
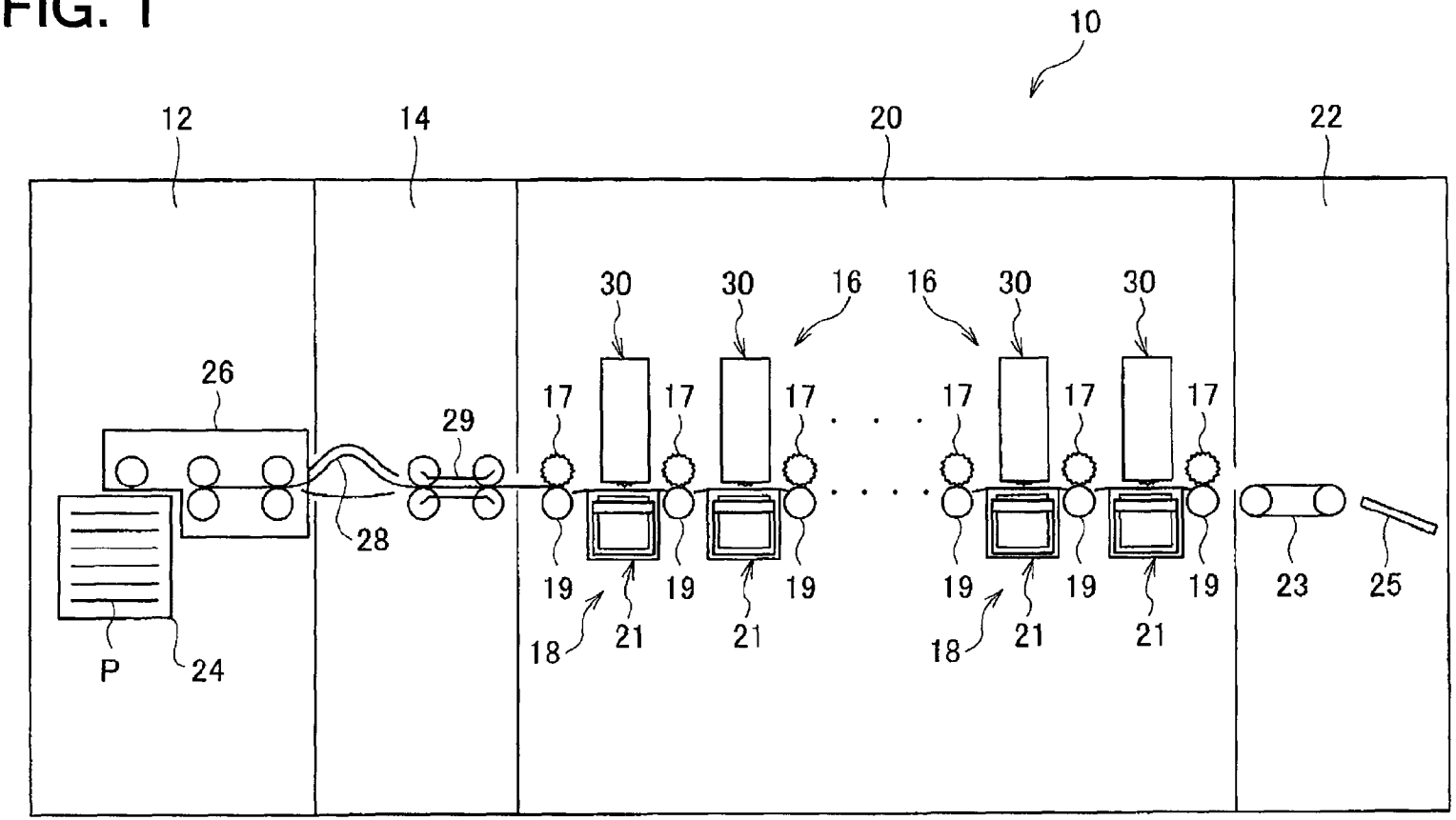
FIG. 1 is a schematic view illustrating the entire configuration of an inkjet recording apparatus.

As illustrated in FIG. 1, the inkjet recording apparatus 10 is basically configured to include a paper-feeding unit 12 to accommodate paper P and discharge the paper when printing an image, a register control unit 14 configured to send out the paper P sent from the paper-feeding unit 12 to recording head units 16 (described below) while controlling the posture of the paper P, recording head units 16 configured to record an image by ejecting ink droplets onto the paper P sent from the register control unit 14, a recording unit 20 equipped with maintenance units 18 configured to maintain the recording head unit 16, and a discharge unit 22 configured to discharge the paper P having an image recorded thereon by the recording unit 20.

The paper-feeding unit 12 is equipped with a stocker 24 where a plurality of sheets of paper P are stacked and stored, and a carrying device 26 configured to pick up the paper one by one from the stocker 24 and carry the paper to the register control unit 14.

The register control unit 14 is equipped with a loop-forming unit 28 and a guide member 29 controlling the posture of the paper P. The paper P sent from the paper-feeding unit passes through the loop-forming unit 28 and the guide member 29 such that skew is corrected by the elasticity of the paper P, and at the same time, the carry timing is controlled to be sent to the recording unit 20.

The recording unit 20 is equipped with the recording head units 16 and the maintenance units 18 opposing each other in an up and down direction and a paper-conveying path on which the paper P sent from the register control unit 14 is conveyed is provided between the recording head units 16 and the maintenance units 18.

The recording head unit 16 is equipped with a plurality of inkjet recording heads (head bars) 30 arranged at predetermined intervals along the paper-conveying path, and multiple pairs of star wheels 17 and conveying rolls 19 opposing each other in an up and down direction are disposed from the upstream sides to the downstream sides of the inkjet recording heads 30, on the paper-conveying path.

The paper P is conveyed along the paper-conveying path while being sandwiched between the star wheels 17 and the conveying rolls 19, and an image is recorded by ink droplets ejected from the inkjet recording heads 30 of the recording head unit 16. In the discharge unit 22, the paper P recorded with an image by the recording unit 20 is conveyed by a discharge belt 23 to be received in a tray 25.

The maintenance unit 18 is equipped with a plurality of maintenance devices 21 each arranged opposing the inkjet recording heads 30. The maintenance device 21 is equipped with a cap (not illustrated) that caps the inkjet recording head 30 to be able to perform processes such as pre-ejecting or vacuuming.

The maintenance device 21 is equipped with a wiper (not illustrated) as an example of a sweeping member that cleans the nozzle surface 36 (see FIG. 4) of the inkjet recording head 30. The wiper is configured to clean the nozzle surface 36 by moving up with respect to the inkjet recording head 30 and then moving in the longitudinal direction of the inkjet recording head 30 (paper's width direction Y).

The inkjet recording apparatus 10 has the configuration described above, and the inkjet recording heads 30 mounted in the inkjet recording apparatus 10 are described in detail hereafter.

Figure 2:
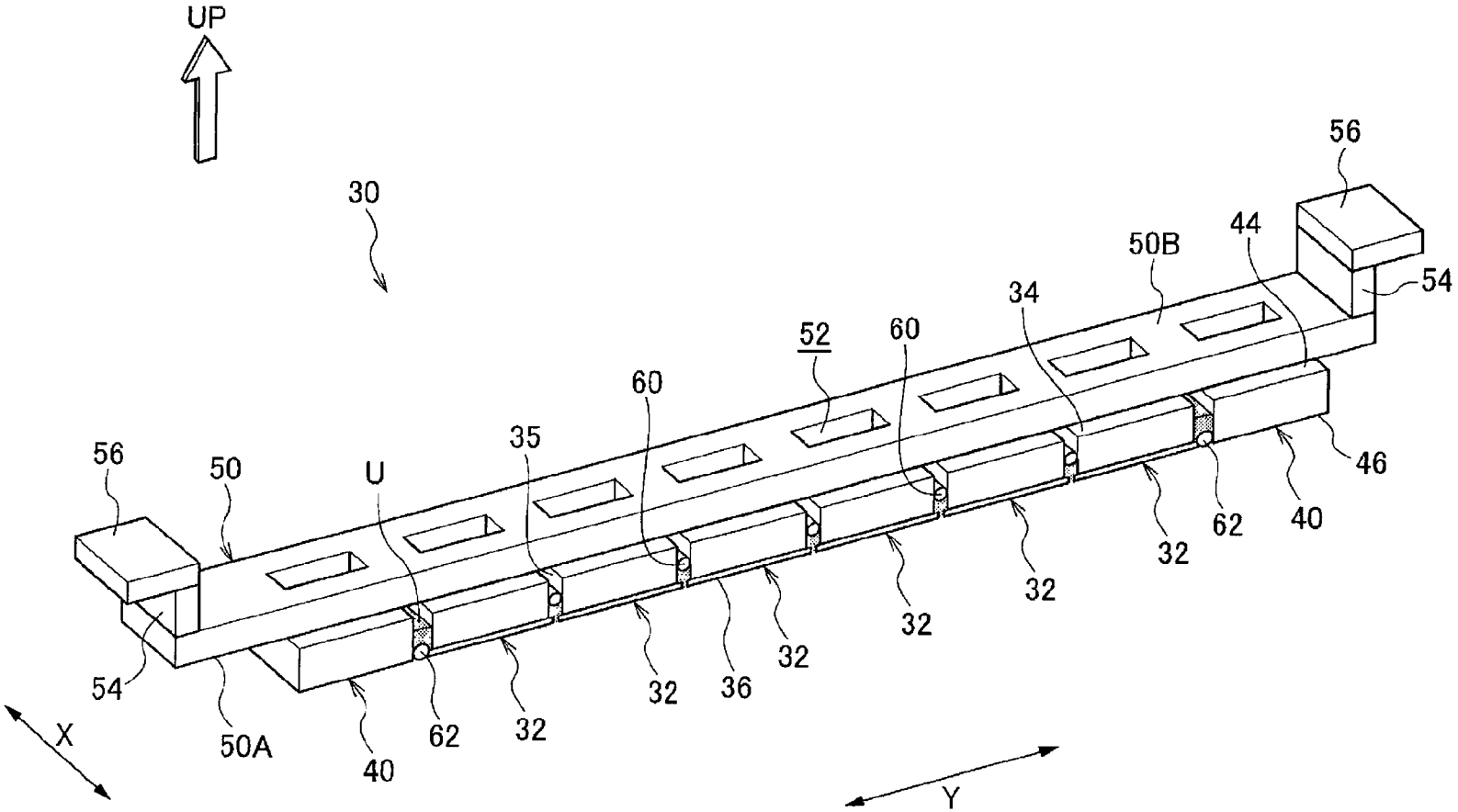
FIG. 2 is a perspective view illustrating the configuration of an inkjet recording head.
Figure 3:
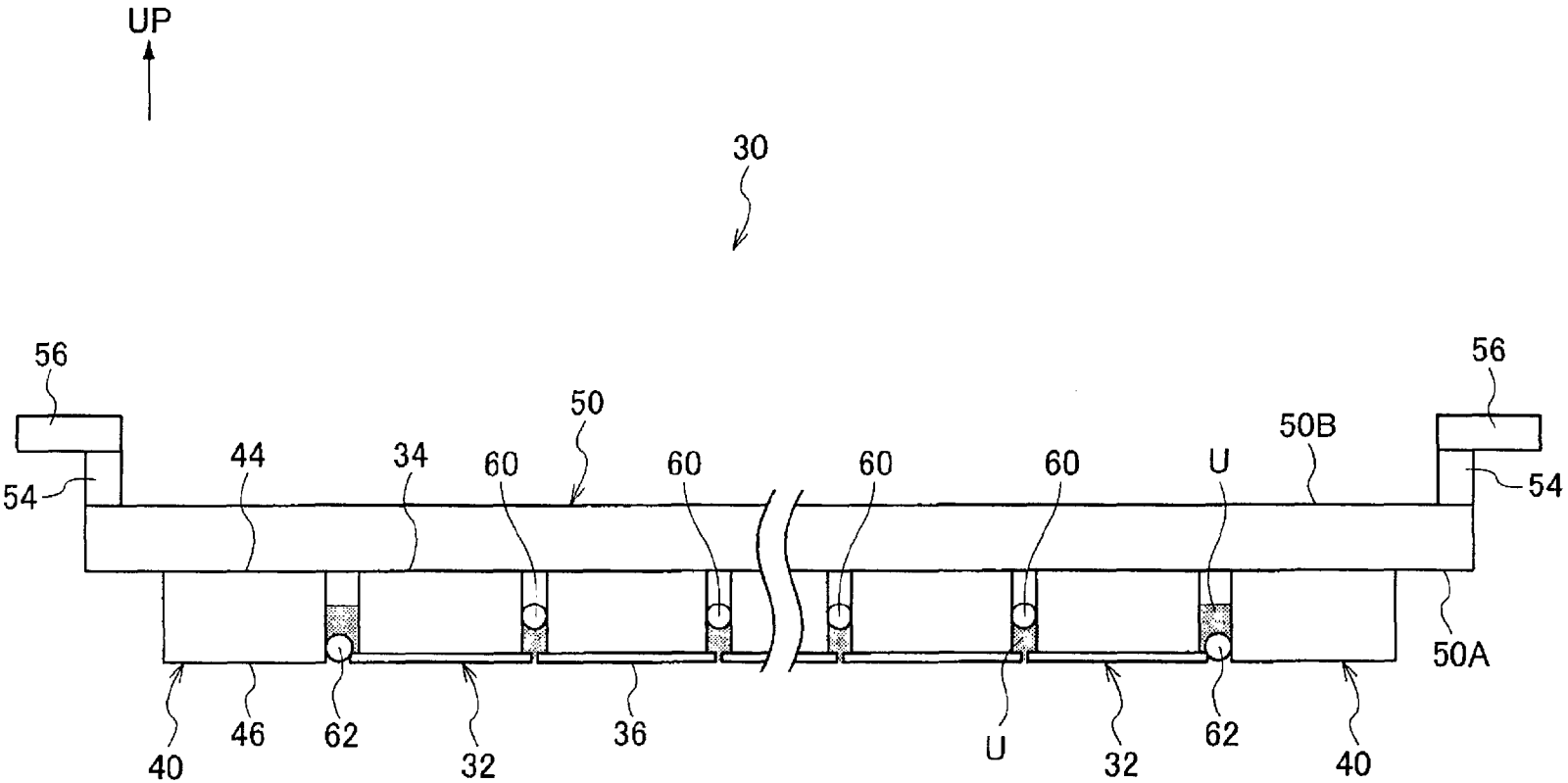
FIG. 3 is a front view illustrating the configuration of the inkjet recording head.
Figure 4:
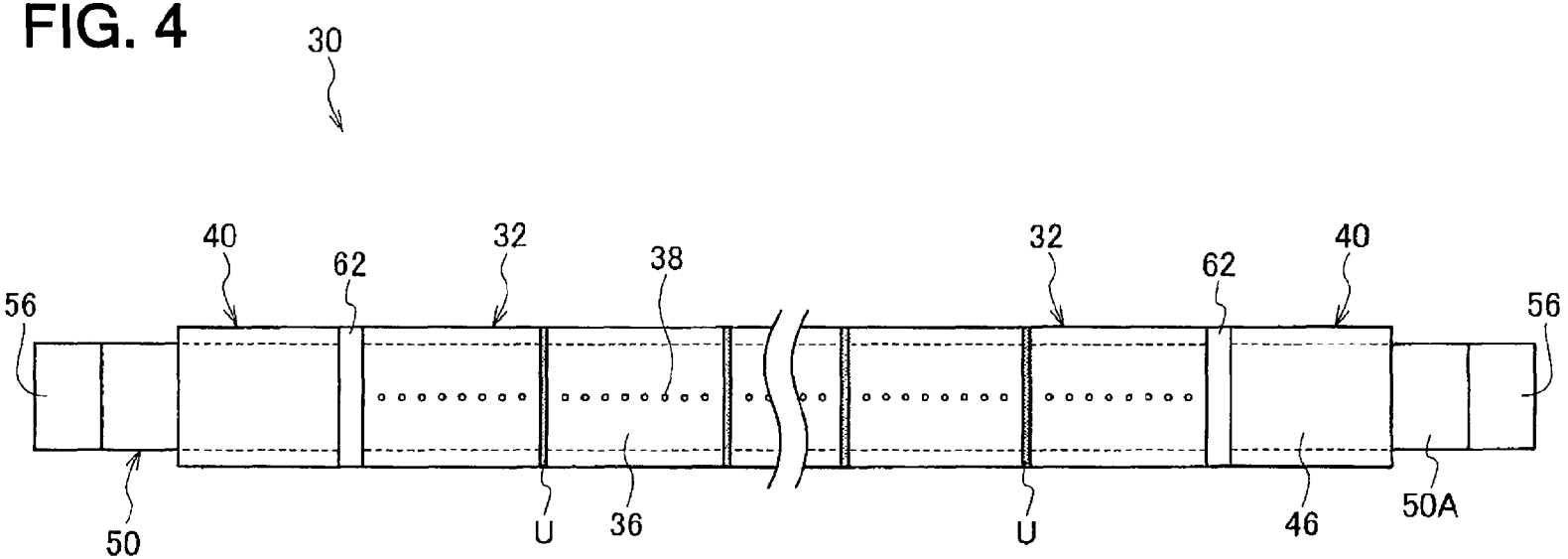
FIG. 4 is a plan view illustrating the configuration of the inkjet recording head.

As illustrated in FIGS. 2 to 4, the inkjet recording head 30 is equipped with the head units, as an example of a plurality of head members, arranged in the paper's width direction Y which is perpendicular to the paper-conveying direction X. A plurality of nozzles 38 is formed in a line in the paper's width direction Y, on the nozzle surface 36 of each of the head unit 32.

Each of the head units 32 is equipped with a piezoelectric device, a diaphragm, and a pressure chamber, for ejecting ink from each of the nozzles 38. Therefore, each of the head units 32 can eject ink droplets from the nozzles 38 onto the paper P conveyed along the paper-conveying path and can record an image on the paper P.

Meanwhile, the inkjet recording apparatus 10 is equipped with at least four inkjet recording heads 30 corresponding to yellow Y, magenta M, cyan C, and black K in order to record so-called full-color images, for example.

Figure 5:
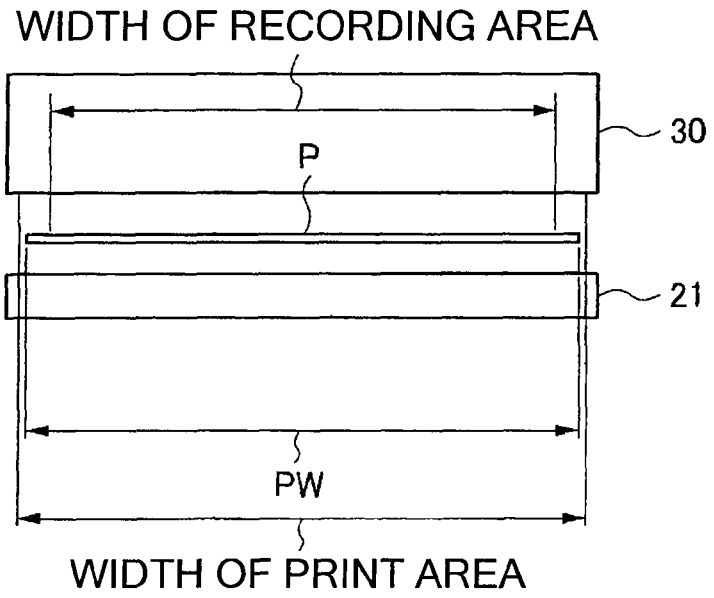
FIG. 5 is a view illustrating a print area by the inkjet recording head.

As illustrated in FIG. 5, the width of the print area defined by the nozzles 38 formed in a line at one inkjet recording head 30 is set to be larger than the paper width PW of the largest paper P where an image is supposed to be recorded in the inkjet recording apparatus 10. Therefore, it is possible to record an image throughout the width of the paper P without moving the inkjet recording heads 30 in the paper's width direction Y.

The print area stated herein is basically the largest one among the recording areas except for the margins that are not printed from both ends of the paper P, but is generally set to be larger than the paper width PW of the printing object. This is because the paper P may be obliquely conveyed (skewed) at an unexpected angle with respect to the paper-conveying direction X and a demand for printing without margin is high.

Although it is exemplified in the exemplary embodiment that the nozzles 38 are formed in one line in the paper's width direction Y, but the present invention is not limited thereto. For example, the nozzles 38 may be arranged in a matrix on a two-dimensional plane in the paper width direction Y and the paper-conveying direction X, for a high-quality image or high-speed printing.

As illustrated in FIGS. 2 to 4, the inkjet recording head 30 includes an elongated substrate 50 with the head units 32 attached to the underside 50A thereof, and dummy units 40 as an example of a pair of dummy members attached to the underside 50A to be arranged in parallel close to the head units 32 (with a gap G2 therebetween, which is described below) at both end portion of the substrate 50 in the longitudinal direction (paper's width direction Y).

The substrate 50 is elongated in the paper's width direction Y, and for example, is made of glass or resin such as acrylic, polycarbonate, polystyrene, and polyethylene terephthalate. A plurality of rectangular openings 52 is formed at predetermined intervals along the longitudinal direction in the substrate 50. Ink supply units (not illustrated) configured to supply ink to the head units 32 from an ink tank (not illustrated) are disposed in the openings 52.

A pair of attachment plates 56 that are members for attaching to the inkjet recording apparatus 10 is disposed on the upper side 50B of the substrate 50 through supporting members 54 at both longitudinal ends of the substrate 50. That is, the substrate 50 is disposed to be bridged on the under-inner sides of the attachment plates 56 in the paper's width direction Y, through the supporting members 54. The head units 32 are attached to the underside 50A of the substrate 50.

In detail, the attachment surfaces 34 opposing the nozzle surfaces 36 are bonded and fixed to the underside 50A of the substrate 50, for example, by an ultraviolet-curable adhesive (not illustrated) such that the head units 32 are arranged in parallel close to each other (with gaps G1 described below) in the longitudinal direction of the substrate 50. Meanwhile, the width of the substrate 50 in the paper-conveying direction X is set to be smaller than the width of the head units 32 in the same direction. Therefore, the inkjet recording head 30 decreases in size.

The dummy units 40 are metallic blocks formed to have the same height (thickness) as that of the head units 32 and have dummy surfaces 46 leveled with (following) the nozzle surfaces 36. The attachment surfaces 44 opposing the dummy surfaces 46 are bonded and fixed to the underside 50A at both end portions of the substrate 50 in the longitudinal direction (arrangement direction of the head units 32), for example, by an ultraviolet-curable adhesive (not illustrated).

The wiper of the maintenance device 21 comes in contact first with the dummy surface 46 of the dummy unit 40 when moving up with respect to the inkjet recording head 30.

That is, when coming in contact first with the nozzle surfaces 36 of the head units 32 by relatively moving up, the wiper may damage the nozzle surfaces 36. In order to prevent damage, the dummy surfaces 46 are disposed at the same height as the nozzle surfaces 36 such that the dummy units 40 are arranged in parallel close to the head units 32 on the underside 50A at both end portions of the substrate 50 in the longitudinal direction.

Therefore, even though the wiper moves up relatively to the inkjet recording head 30, the nozzle surfaces 36 of the head units 32 are not damaged by the wiper, and the wiper is configured to clean the nozzle surfaces 36 by smoothly moving from the dummy surfaces 46 of the dummy unit 40 to the nozzle surfaces 36 of the head units 32.

Figure 6A:
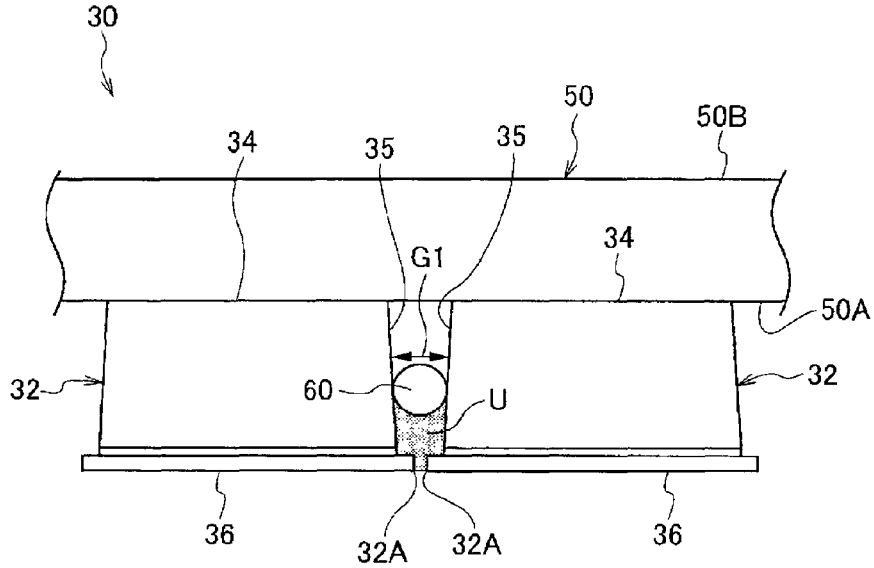
FIG. 6A is a partially enlarged front view illustrating a gap between head units and FIG. 6B is a partial enlarged front view illustrating a gap between the head unit and a dummy unit.
Figure 6B:
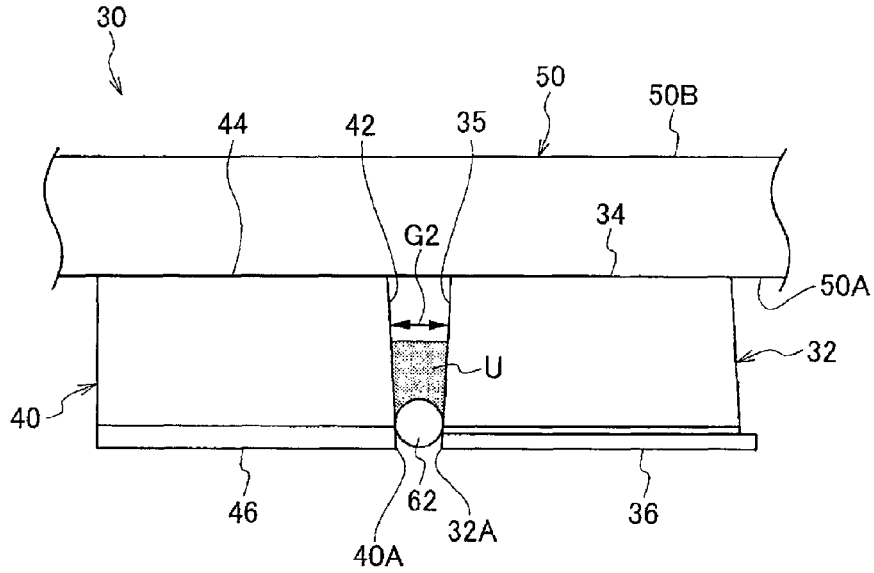

As illustrated in FIGS. 6A and 6B, a small gap G1 is defined between the sidewall surfaces 35 of the head units 32 and a gap G2 (G2>G1) slightly larger than the gap G1 is defined between the sidewall surface 35 of the head unit 32 and a sidewall surface 42 of the dummy unit 40.

Meanwhile, as shown in FIGS. 6A and 6B, the gap G1 between the sidewall surfaces 35 of the adjacent head units 32 and the gap G2 between the sidewall surface 35 of the head unit 32 and the sidewall surface 42 of the dummy unit 40 are configured to become narrow toward the nozzle surface 36 and the dummy surface 46 from the attachment surfaces 34 and 44, respectively, (to become widen toward the attachment surfaces 34 and 44 from the nozzle surface 36 and the dummy surface 46, respectively).

That is, the sidewall surface 35 of the head unit 32 and the sidewall surface 42 of the dummy unit 40 are formed in tapered surfaces such that the outer shapes of the head unit 32 and the dummy unit 40 gradually increase toward the nozzle surface 36 and the dummy surface 46, respectively, (the outer shapes of the head unit 32 and the dummy unit 40 gradually decrease toward the attachment surfaces 34 and 44, respectively) when seen from the front side of the paper-conveying direction X.

The gaps G1 and G2 are exaggerated in the figures for easy understanding of the configuration. That is, the gap G1 between the sidewall surfaces 35 at the lowermost ends 32A of the nozzle surfaces 36 of the head units 32 is actually set, for example, to 0.05 mm, and the gap G1 between the sidewall surfaces 35 at predetermined positions, which are spaced from the nozzle surfaces 36 and between which a resin tube 60 described blow is inserted, is actually set, for example, to 0.5 mm, when the outer diameter of the resin tube 60 is 0.6 mm.

As described above, since the value of the gap G1 is not constant in the height direction, it is possible to adjust the gap G1 between the sidewall surfaces 35 at the lowermost ends 32 of the nozzle surfaces 36 of the head units 32 by appropriately adjusting the outer diameter of the resin tube 60 or the position where the resin tube 60 is inserted. In the mean time, the sidewall surface 42 of the dummy unit 40 may not be tapered, but since the sidewall surface 35 of the head unit 32 is tapered, the value of the gap G2 may not be constant as well in the height direction.

The gaps G1 and G2 are filled with an adhesive U bonding the sidewall surfaces 35 of the adjacent head units 32, and the sidewall surface 35 of the head unit 32 and the sidewall surface 42 of the dummy unit 40. The adhesive may be, for example, a room temperature-curable adhesive and an adhesive having low viscosity of, for example, about 25 Pa·s to 45 Pa·s at room temperature (in detail, SE9186L by Dow Corning Toray Co., Ltd) before curing is optimum.

As the adhesive U hardens, the gaps G1 and G2 are sealed. That is, the adhesive U is an example of a sealant that seals the gaps G1 and G2. The hollow-shaped resin tube 60, which is an example of an elastic member preventing the adhesive from leaking from the attachment surface 34 before hardening, is disposed in the gap G1, and a hollow-shaped resin tube 62, which is an example of an elastic member preventing the adhesive U from leaking from the nozzle surface 36 before hardening, is disposed in the gap G2.

The resin tubes 60 and 62 are, for example, soft silicon tubes that are continuously supplied in the paper-conveying direction X when the inkjet recording head 30 is manufactured, and the hardness is set to be 2 or less by JISK6253. The resin tubes 60 and 62 are inserted into the gaps G1 and G2, respectively, before filling of the adhesive U.

That is, the adhesive U is filled, while the resin tubes 60 and 62 are being inserted, and the resin tubes 60 and 62 are cut in conformity with the width (size) of the head units in the paper-conveying direction X, after the adhesive U hardens. As described above, the resin tubes 60 and 62 are one of the components of the inkjet recording head 30.

In more detail, the resin tube 60 to be disposed between the sidewall surfaces 35 of the head units 32 is disposed at a predetermined height from the nozzle surfaces 36 (substantially at the middle portion of the head unit 32 in the height direction) to define the gap G1 between the sidewall surfaces 35 at the lowermost ends 32A of the nozzle surfaces 36 of the head units 32. The adhesive U is filled in between the resin tube 60 and the lowermost ends 32A of the head units 32.

Since the gap G1 between the sidewall surfaces 35 at the lowermost ends 32A of the adjacent head units 32 is very small, for example, 0.05 mm, surface tension is generated on the adhesive U that has not hardened yet, in the gap G1 between the sidewall surfaces 35 at the lowermost ends 32A, such that the adhesive U does not leak from the nozzle surfaces 36. Therefore, the resin tube 60 blocks the adhesive U, which has not hardened yet, to prevent leakage from the attachment surfaces 34 (with the gap G1 increased), by being disposed at a predetermined position spaced from the nozzle surfaces 36 (substantially at the middle portion in the height direction of the head unit 32).

Meanwhile, the resin tube 62 to be disposed between the sidewall surface 35 of the head unit 32 and the sidewall surface 42 of the dummy unit 40 has an outer diameter equal to or larger than that of the resin tube 60, and is disposed such that the underside is positioned substantially at the same height as the nozzle surface 36 and the dummy surface 46 to fill the gap G2 between the sidewall surface 35 of the nozzle surface 36 and the sidewall surface 42 of the dummy surface 46.

That is, since the gap G2 between the sidewall surface of the head unit 32 and the sidewall surface 42 of the dummy unit 40 is larger than the gap G1 between the sidewall surfaces 35 of the head units 32, surface tension is difficult to be generated on the adhesive U that has not hardened yet, between the sidewall surface 35 at the lowermost end 32A of the nozzle surface 36 of the head unit 32 and the sidewall surface 42 at the lowermost end 40A of the dummy surface 46 of the dummy unit 40.

Therefore, the resin tube 62 configured to block the adhesive U, which has not hardened yet, to prevent leakage from the nozzle surface 36 (dummy surface 46), by being disposed with the underside positioned substantially at the same height as the nozzle surface 36 and the dummy surface 46. Meanwhile, the adhesive U that has not hardened yet is filled on the resin tube 62 disposed substantially at the same height as the nozzle surface 36 and the dummy surface 46, such that the adhesive U does not leak from the attachment surface 34 (attachment surface 44), unless filled more than necessary.

The action (operation) of the inkjet recording apparatus 10 having the configuration is briefly described hereafter.

When a print work is inputted to the inkjet recording apparatus 10 and printing (recording an image) is started, a sheet of paper P is picked up from the stocker 24 and conveyed to the recording unit 20 by the conveying device 26.

Meanwhile, ink has been injected (filled) in the head units 32 from the ink tank by the ink supply unit, in the inkjet recording heads 30. Meniscuses with a slight recess on the surface of ink are formed at the front ends (ejection port) of the nozzles 38.

Therefore, an image based on image data is recorded on the paper P by selectively ejecting ink droplets from the nozzles 38 of the head units 32 while the paper P is conveyed at a predetermined conveying speed.

In order to maintain the head units 32, the caps are disposed at maintenance positions to cap the head units 32. Accordingly, the nozzle surfaces 36 of the inkjet recording head 30 are covered by the caps and closed spaces are defined.

In this state, a pump (not illustrated) of the maintenance device 21 operates and the closed space becomes under negative pressure, and lumps of ink clogging the nozzles 38 can be discharged by sucking the nozzles 38.

The wiper relatively moves up to come in contact with the dummy units 40. The nozzle surfaces 36 of the head units 32 are wiped by moving the wiper in the longitudinal direction of the substrate 50. Accordingly, ink remaining around the nozzles 38 is removed from the nozzle surfaces 36.

Next, a method of manufacturing the inkjet recording head 30 of the present exemplary embodiment will be described in detail with reference to FIGS. 7 to 13. First, a method of filling the adhesive U into the gap G1 between the head units 32 according to the first exemplary embodiment illustrated in FIGS. 7 to 10 and a method of filling the adhesive U into the gap G2 between the head unit 32 and the dummy unit 40 will be described.

Figures 7A, 7B, 7C, 7D, 7E:
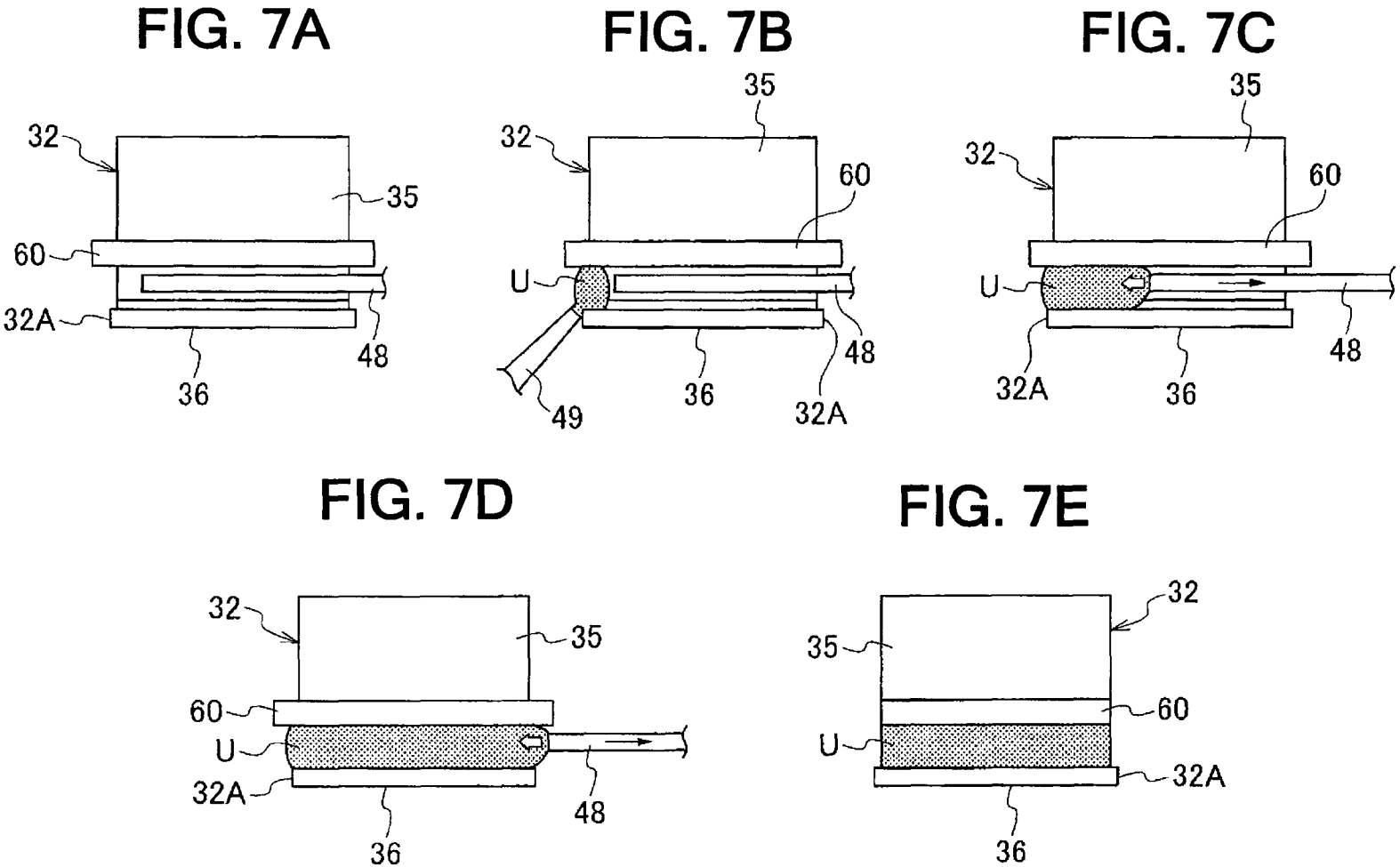
FIGS. 7A to 7E are views illustrating a manufacturing process according to a first exemplary embodiment for sealing the gap between head units.

As illustrated in FIG. 7A, the resin tube 60 is inserted into the gap G1 between the sidewall surfaces 35 of adjacent head units 32. In detail, the resin tube 60 is disposed at an appropriate position spaced from the nozzle surfaces 36 between the sidewall surfaces 35 such that the gap G1 between the sidewall surfaces 35 at the lowermost ends 32A of the head units 32 becomes, for example, about 0.05 mm (a first disposing process). A needle 48 for supplying the adhesive U is inserted into the gap G1 between the lowermost sides 32A and the resin tube 60.

Next, as shown in FIG. 7B, an adhesive U is supplied by a separate needle 49 between the lowermost ends 32A and the resin tube 60 at one end (one side) of the head unit 32 in the paper-conveying direction X, thereby blocking the one end in advance with the adhesive (a barrier building process). Thereafter, as illustrated in FIG. 7C, the needle 48 is moved to the other end of the head unit 32 in the paper-conveying direction X while supplying the adhesive U from the front end of the needle 48.

Meanwhile, since the gap G1 between the sidewall surfaces 35 at the lowermost ends 32A is a very small gap, for example, of about 0.05 mm, surface tension is generated on the adhesive U that has not hardened yet, in the gap G1. Therefore, the adhesive U does not leak from the nozzle surfaces 36. Since the adhesive U is prevented from moving up by the resin tube 60, such that the adhesive does not also leak from the attachment surfaces 34.

Accordingly, as illustrated in FIG. 7D, after the gap G1 between the resin tube 60 and the lowermost ends 32A is filled with the adhesive U, the needle 48 is retreated and the adhesive U is left at room temperature or heated to be hardened. That is, the gap G1 is sealed by the adhesive U (sealing process). After the adhesive U hardens (seals the gap G1), as shown in FIG. 7E, the resin tube 60 or the adhesive U that protruded from the one end and the other end of the head unit 32 in the paper-conveying direction X is cut (a cutting process).

Figure 8A:
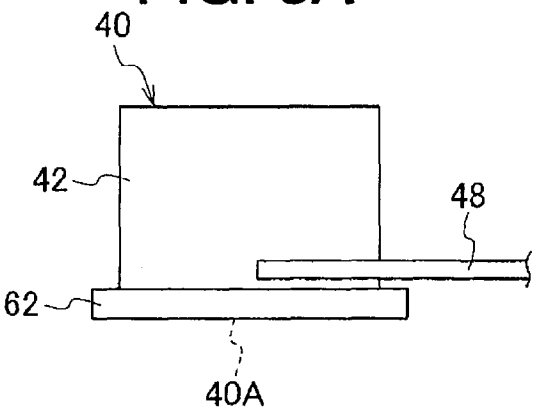
FIGS. 8A to 8E are views illustrating a manufacturing process according to a first exemplary embodiment for sealing the gap between the head unit and the dummy unit.

Meanwhile, as illustrated in FIG. 8A, the resin tube 62 is inserted between the sidewall surface 35 of the head unit 32 and the sidewall surface 42 of the dummy unit 40. In detail, the resin tube 62 is disposed between the sidewall surface 35 of the head unit 32 at the lowermost end 32A and the sidewall surface 42 of the dummy unit 40 at the lowermost end 40A (a second disposing process). The needle 48 for supplying the adhesive U is inserted into the gap G2 on the resin tube 62.

Figure 8B:
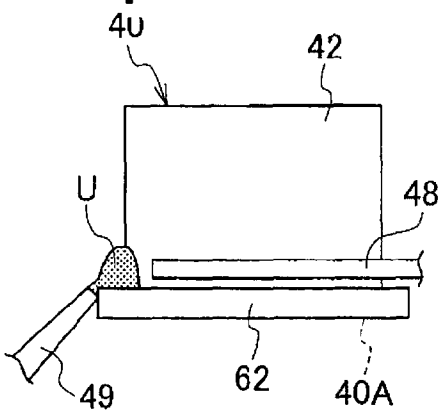
Figure 8C:
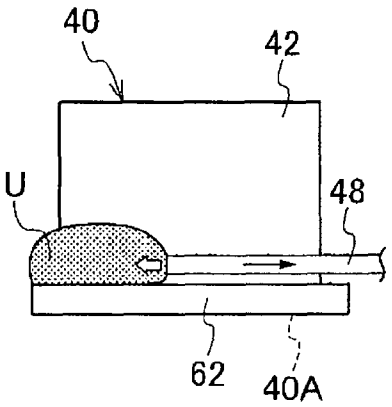

Next, as illustrated in FIG. 8B, an adhesive U is supplied by a separate needle 49 to one end (one side) of the head unit 32 in the paper-conveying direction X on the resin tube 62, thereby blocking the one end in advance with the adhesive (a barrier building process). Thereafter, as illustrated in FIG. 7C, the needle 48 is moved to the other end of the head unit 32 in the paper-conveying direction X while supplying the adhesive U from the front end of the needle 48.

Since the adhesive U is prevented from moving down by the resin tube 62 disposed between the sidewall surface 35 of the head unit 32 at the lowermost end 32A and the sidewall surface 42 of the dummy unit 40 at the lowermost end 40A, the adhesive U does not leak from the nozzle surface 36 (dummy surface 46). Since the adhesive U is filled on the resin tube 62, the adhesive U does not leak from the attachment surface (attachment surface 44), unless filled more than necessary.

Figure 8D:
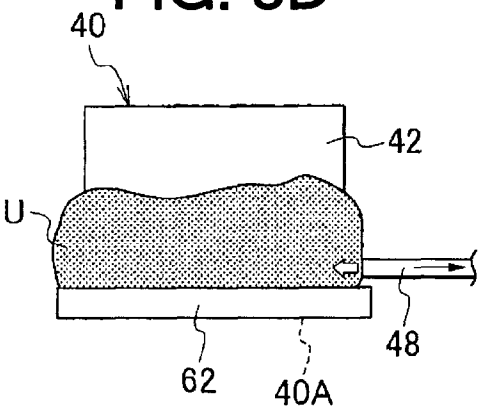
Figure 8E:
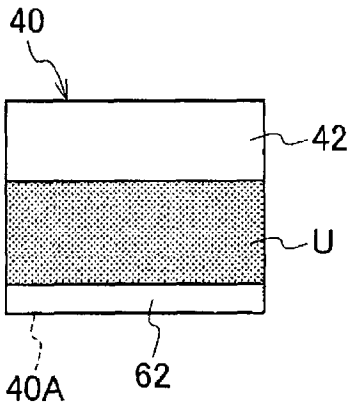

Accordingly, as illustrated in FIG. 8D, after the gap G2 above the resin tube 62 is filled with the adhesive U, the needle 48 is retreated and the adhesive U is left at room temperature or heated to be hardened. That is, the gap G2 is sealed and blocked by the adhesive U (a sealing process). After the adhesive U hardens (seals the gap G1), as shown in FIG. 8E, the resin tube 62 or the adhesive U that protruded from one end and the other end of the head unit 32 in the paper-conveying direction X is cut (a cutting process). As a result, the inkjet recording head 30 illustrated in FIGS. 2 to 4 and 6 is manufactured (completed).

As the method of filling the adhesive U into the gap G2 between the head unit 32 and the dummy unit 40 according to the first exemplary embodiment, a method illustrated in FIG. 9 may be adopted.

Figure 9A:
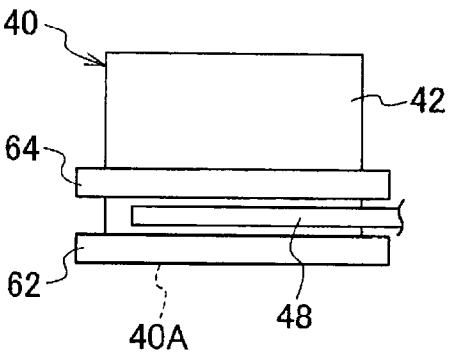
FIGS. 9A to 9E are views illustrating a modified example of the manufacturing process according to the first exemplary embodiment for sealing the gap between the head unit and the dummy unit.

That is, as illustrated in FIG. 9A, the resin tube 62 is inserted and disposed in between the sidewall surface 35 of the head unit 32 at the lowermost end 32A and the sidewall surface 42 of the dummy unit 40 at the lowermost end 40A, and at the same time, a separate resin tube 64 is inserted and disposed at an appropriate position spaced from the nozzle surface 36 between the sidewall surface 35 of the head unit 32 and the sidewall surface 42 of the dummy unit 40 (a second disposing process).

Figure 9B:
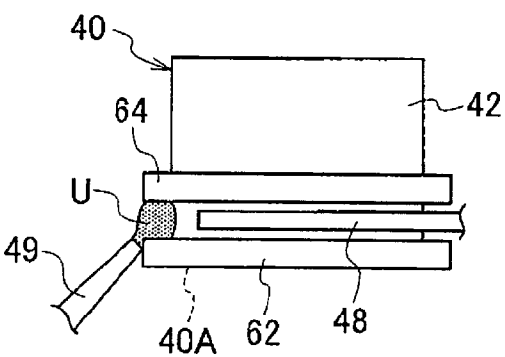

A needle 48 for supplying the adhesive U is inserted into the gap G2 between the resin tube 62 and the resin tube 64. Next, as illustrated in FIG. 9B, an adhesive U is supplied by a separate needle 49 to one end (one side) of the head unit 32 in the paper-conveying direction X between the resin tubes and 64, thereby blocking one end in advance with the adhesive U (a barrier building process).

Figure 9C:
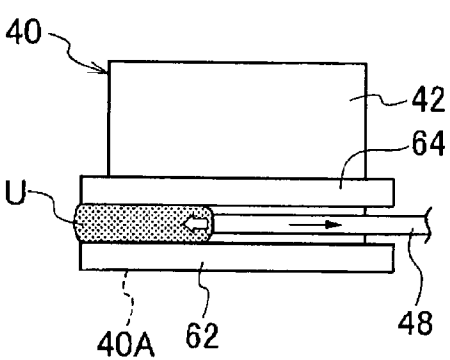

Thereafter, as illustrated in FIG. 9C, the needle 48 is moved to the other end of the head unit 32 in the paper-conveying direction X while supplying the adhesive U from the front end of the needle 48. Meanwhile, since the adhesive U is prevented from moving down by the resin tube 62 and from moving up by the resin tube 64, the adhesive U does not leak from the nozzle surface 36 (dummy surface 46) and the attachment surface 34 (attachment surface 44).

Figure 9D:
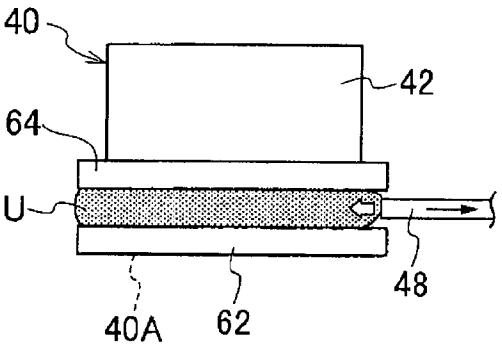
Figure 9E:
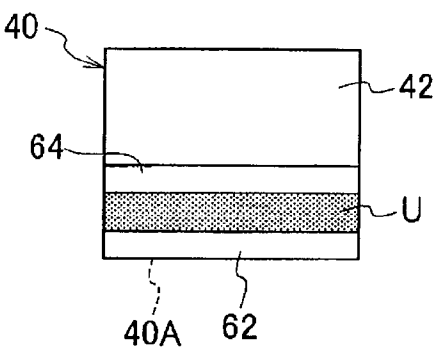

Accordingly, as illustrated in FIG. 9D, after the gap G2 between the resin tube 62 and the resin tube 64 is filled with the adhesive U, the needle 48 is retreated and the adhesive U is left at room temperature or heated to be hardened. That is, the gap G2 is sealed by the adhesive U (a sealing process). After the adhesive U hardens (seals the gap G1), as shown in FIG. 9E, the resin tubes 62 and 64 or the adhesive U that protruded from one end or the other end of the head unit 32 in the paper-conveying direction X is cut (a cutting process). The inkjet recording head 30 may be manufactured by this process.

As described above, since the gap G1 between the sidewall surfaces 35 of the head units 32 at the lowermost ends 32A is a very small gap, for example, of about 0.05 mm, surface tension is generated on the adhesive U that has not hardened yet, in the gap G1. Therefore, the adhesive U does not leak from the lowermost ends 32A to the nozzle surfaces 36.

Figure 10:
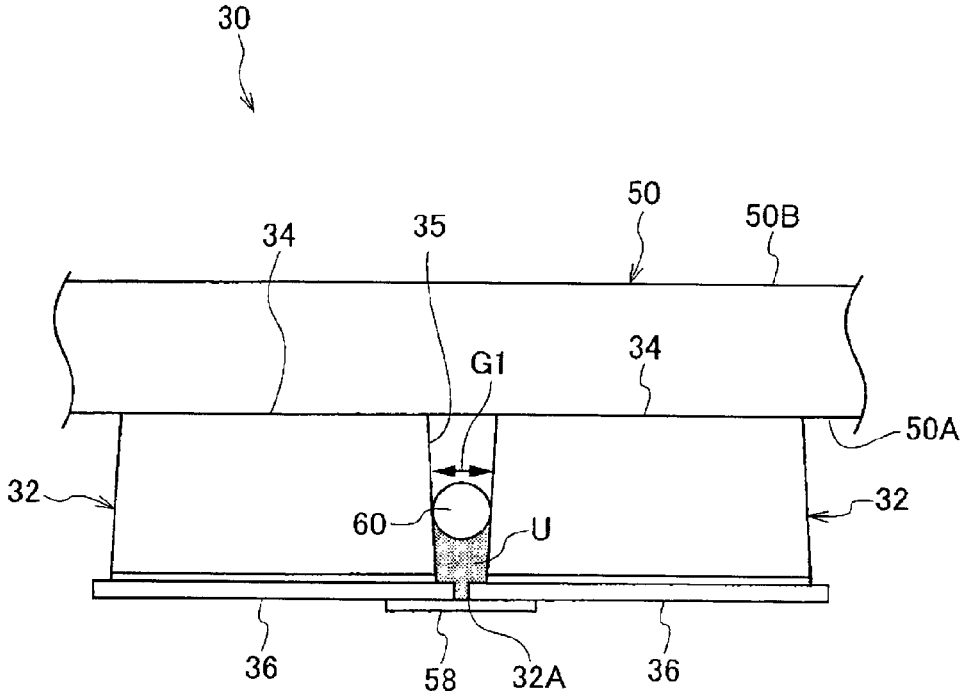
FIG. 10 is a partially enlarged front view illustrating a case where an adhesive tape is attached across adjacent nozzle surfaces in the manufacturing process according to the first exemplary embodiment.

However, as illustrated in FIG. 10, an adhesive tape 58 may be adhered across the nozzle surfaces 36 of adjacent head unit 32 (to block the gap G1) before at least sealing (adhering process). Accordingly, it is possible to further prevent the adhesive U from leaking to the nozzle surfaces 36, when the adhesive U is filled, by making the nozzle surfaces 36 to be oriented downwad. Meanwhile, the adhesive tape 58 is detached after the sealing (a detaching process).

Next, a method of filling the adhesive U into the gap G1 between the head units 32 according to a second exemplary embodiment illustrated in FIGS. 11 to 13 and a method of filling the adhesive U into the gap G2 between the head unit 32 and the dummy unit 40 will be described.

Meanwhile, in the second exemplary embodiment, the adhesive U is supplied by the resin tube 60, the resin tube 62, or the resin tube 64, and a plurality of through-holes 60A, 64A, and 62A for supplying the adhesive U is formed at regular intervals through the undersides (outer circumferential surfaces) of the resin tubes 60 and 64 and the upper side (outer circumferential surface) of the resin tube 62, respectively.

Figures 11A, 11B, 11C, 11D:
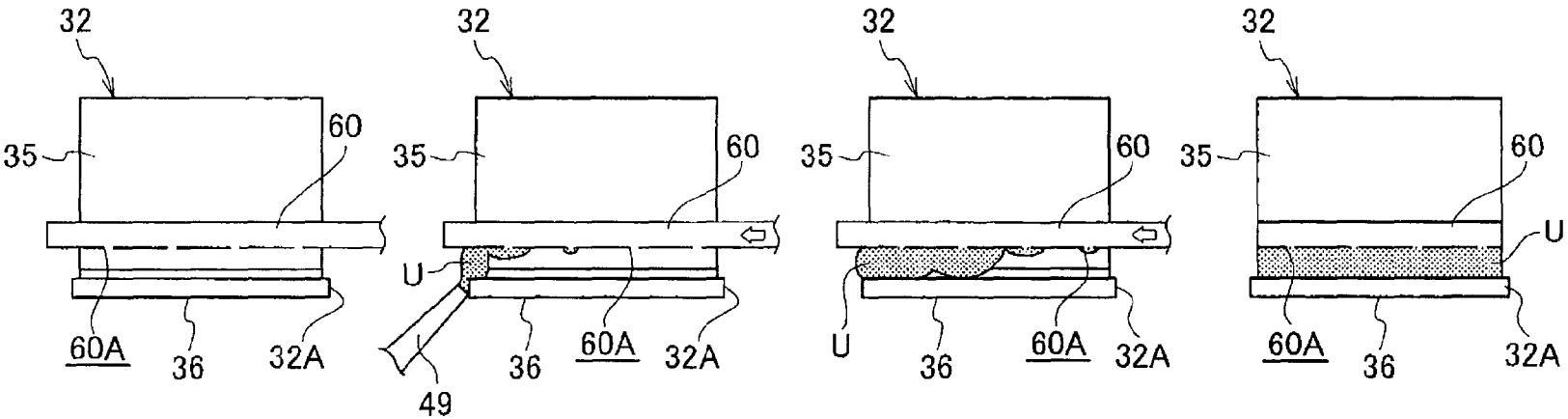
FIGS. 11A to 11D are views illustrating a manufacturing process according to a second exemplary embodiment for sealing the gap between head units.

As illustrated in FIG. 11A, the resin tube 60 is inserted into the gap G1 between the sidewall surfaces 35 of adjacent head units 32. In detail, the resin tube 60 is disposed at an appropriate position spaced from the nozzle surfaces 36 between the sidewall surfaces 35 such that the gap G1 between the sidewall surfaces 35 at the lowermost ends 32A of the head units 32 becomes, for example, about 0.05 mm (a first disposing process).

As illustrated in FIG. 11B, an adhesive U is supplied by a separate needle 49 at one end (one side) of the head unit 32 in the paper-conveying direction X between the lowermost ends 32A and the resin tube 60, thereby blocking the one end in advance with the adhesive (a barrier building process). Next, as illustrated in FIG. 11C, the gap G1 between the resin tube 60 and the lowermost ends 32A is filled with the adhesive U by supplying the adhesive U from the through-holes 60A of the resin tube 60.

Since the gap G1 between the sidewall surfaces 35 at the lowermost ends 32A is a very small gap, for example, of about 0.05 mm, surface tension is generated on the adhesive U that has not hardened yet, in the gap G1. Therefore, the adhesive U does not leak from the nozzle surfaces 36. Since the adhesive U is prevented from moving up by the resin tube 60, such that the adhesive does not also leak from the attachment surfaces 34.

Accordingly, after the gap G1 between the resin tube 60 and the lowermost ends 32A is filled with the adhesive U, the adhesive U is left at room temperature or heated to be hardened. That is, the gap G1 is sealed and blocked by the adhesive U (sealing process). After the adhesive U hardens (seals the gap G1), as shown in FIG. 11D, the resin tube 60 or the adhesive U that protrudes from the one end and the other end of the head unit 32 in the paper-conveying direction X is cut (a cutting process).

Figure 12A:
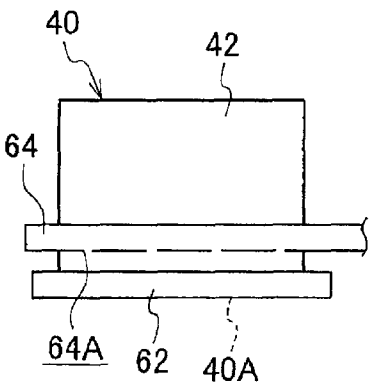
FIGS. 12A to 12D are views illustrating a manufacturing process according to a second exemplary embodiment for sealing the gap between the head unit and the dummy unit.

Meanwhile, as illustrated in FIG. 12A, the resin tube 62 is inserted and disposed in between the sidewall surface 35 of the head unit 32 at the lowermost end 32A and the sidewall surface 42 of the dummy unit 40 at the lowermost end 40A, and at the same time, a separate resin tube 64 is inserted and disposed at an appropriate position spaced from the nozzle surface 36 between the sidewall surface 35 of the head unit 32 and the sidewall surface 42 of the dummy unit 40 (a second disposing process).

Figure 12B:
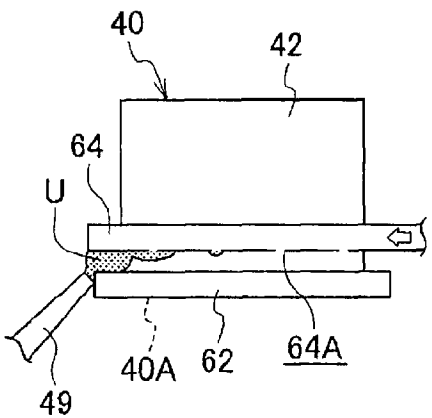
Figure 12C:
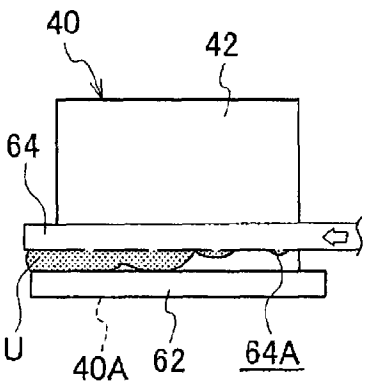

As illustrated in FIG. 12B, an adhesive U is supplied by a separate needle 49 to one end (one side) of the head unit 32 in the paper-conveying direction X between the resin tube 62 and the resin tube 64, thereby blocking one end in advance with the adhesive U (a barrier building process). Next, as illustrated in FIG. 12C, the gap G2 between the resin tube 62 and the resin tube 64 is filled with the adhesive U by supplying the adhesive U from the through-holes 64A of the upper resin tube 64.

Since the adhesive U is prevented from moving down by the resin tube 62 and from moving up by the resin tube 64, the adhesive U does not leak from the nozzle surface 36 (dummy surface 46) and the attachment surface 34 (attachment surface 44).

Figure 12D:
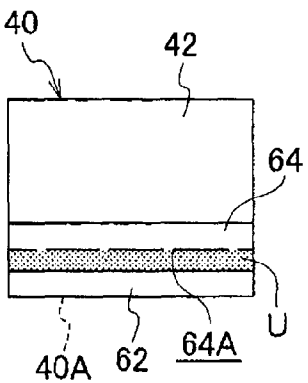

Accordingly, after the gap G2 between the resin tube 62 and the resin tube 64 is filled with the adhesive U, the adhesive U is left at room temperature or heated to be hardened. That is, the gap G1 is sealed and blocked by the adhesive U (a sealing process). After the adhesive U hardens (seals the gap G2), as shown in FIG. 12D, the resin tubes 62 and 64 or the adhesive U that protruded from one end or the other end of the head unit 32 in the paper-conveying direction X is cut (a cutting process). The inkjet recording head 30 is manufactured (completed) by this process.

As the method of filling the adhesive U into the gap G2 between the head unit 32 and the dummy unit 40 according to the second exemplary embodiment, the method illustrated in FIG. 13 may be adopted.

Figure 13C:
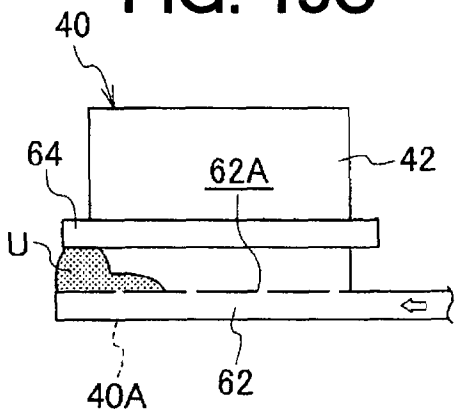
FIGS. 13A to 13E are views illustrating a modified example of the manufacturing process according to the second exemplary embodiment for sealing the gap between the head unit and the dummy unit.
Figure 13B:
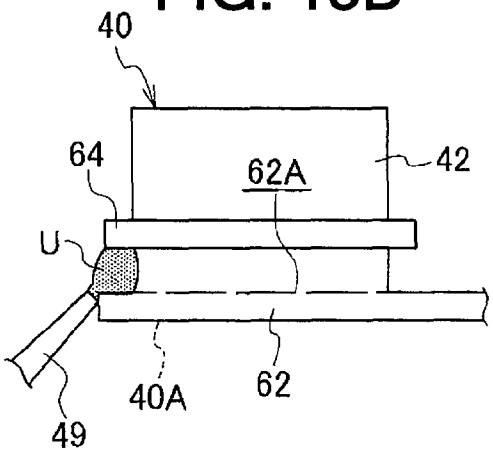
Figure 13A:
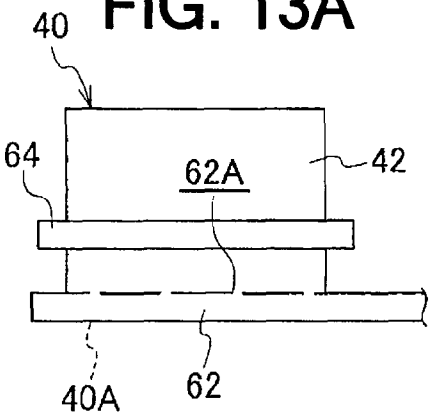

That is, as illustrated in FIG. 13A, the resin tube 62 is inserted and disposed in between the sidewall surface 35 of the head unit 32 at the lowermost end 32A and the sidewall surface 42 of the dummy unit 40 at the lowermost end 40A, and at the same time, a separate resin tube 64 is inserted and disposed at an appropriate position spaced from the nozzle surface 36 between the sidewall surface 35 of the head unit 32 and the sidewall surface 42 of the dummy unit 40 (a second disposing process).

Figure 13E:
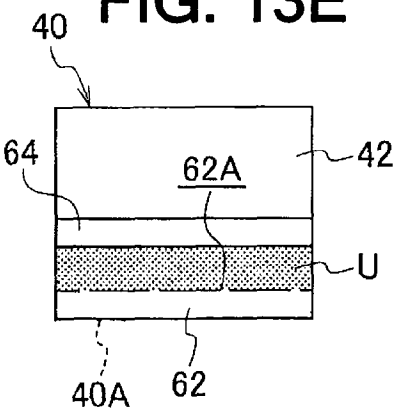
Figure 13D:
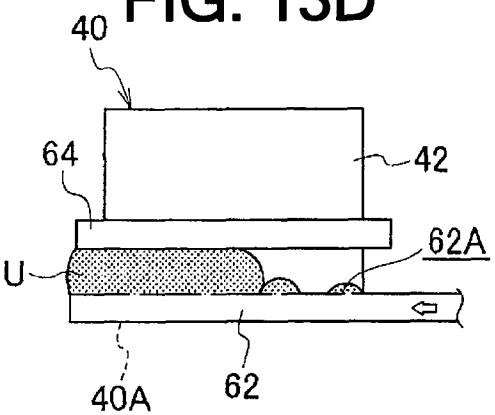

As illustrated in FIG. 13B, an adhesive U is supplied by a separate needle 49 to one end (one side) of the head unit 32 in the paper-conveying direction X between the resin tube 62 and the resin tube 64, thereby blocking one end in advance with the adhesive U (a barrier building process). As illustrated in FIGS. 13C and 13D, the gap G2 between the resin tube 62 and the resin tube 64 is filled with the adhesive U by supplying the adhesive U from the through-holes 62A of the lower resin tube 62.

Since the adhesive U is prevented from moving down by the resin tube 62 and from moving up by the resin tube 64, the adhesive U does not leak from the nozzle surface 36 (dummy surface 46) and the attachment surface 34 (attachment surface 44).

Accordingly, after the gap G2 between the resin tube 62 and the resin tube 64 is filled with the adhesive U, the adhesive U is left at room temperature or heated to be hardened. That is, the gap G1 is sealed and blocked by the adhesive U (a sealing process). After the adhesive U hardens (seals the gap G1), as shown in FIG. 13E, the resin tubes 62 and 64 or the adhesive U that protruded from one end or the other end of the head unit 32 in the paper-conveying direction X is cut (a cutting process). The inkjet recording head 30 may be manufactured by this process.

Even in the second exemplary embodiment, as illustrated in FIG. 10, the gap G1 may be blocked by an adhesive tape 58. That is, an adhesive tape 58 may be adhered across the nozzle surfaces 36 of adjacent head unit 32 before at least sealing (an adhering process) and the adhesive tape 58 may be detached after the sealing (a detaching process).

As described above, although the method of filling the adhesive U by using the needle 48 is described as the first exemplary embodiment and the method o filling the adhesive U by using the resin tubes 60, 62, and 64 is described as the second exemplary embodiment, the method of filling the adhesive U into the gap G1 between the head units 32 and the method of filling the adhesive U into the gap G2 between the head unit 32 and the dummy unit 40 may be implemented by appropriately combining the first exemplary embodiment with the second exemplary embodiment.

That is, for example, the first exemplary embodiment using the needle 48 may be employed for filling the adhesive U into the gap G1 between the head units 32 and the second exemplary embodiment using the resin tube 62 or the resin tube 64 for supplying an adhesive may be employed for filling the adhesive U into the gap G2 between the head unit 32 and the dummy unit 40. Meanwhile, supplying the adhesive U by using the resin tubes 60, 62, and 64 has advantage in that the configuration of the apparatus can be simplified, as compared with a case where the adhesive U is supplied using the needle 48.

In the exemplary embodiments, the resin tubes 60, 62, and 64 for building a barrier (not supplying an adhesive) which are inserted in the gap G1 between the head units 32 and the gap G2 between the head unit 32 and the dummy unit 40 are not inflated, but it may be possible to inflate the resin tubes 60, 62, and 64 for building a barrier before filling the adhesive U. This can more effectively block the adhesive U.

The resin tubes 60, 62, and 64 for building a barrier may not be formed in a hollow shape. The nozzle surfaces 36 may be oriented downward or upward, when the inkjet recording head 30 is manufactured.

Although a droplet ejection head according to the exemplary embodiments and a method of manufacturing the droplet ejection head are described above, the droplet ejection head and the method of manufacturing the same are not limited to those illustrated in the figures, and may be changed and modified in various ways.

Although ink droplets are selectively ejected from each of the inkjet recording heads 30 for each color of black, yellow, magenta, and cyan on the basis of the image data and a full-color image is recorded onto the paper P in the inkjet recording apparatus 10 according to the exemplary embodiments described above, the inkjet recording in the present invention is not limited to the recording of a character or an image onto the paper P.

That is, the recording medium is not limited to paper and the liquid to be ejected is not limited to ink. For example, the inkjet recording head 30 (droplet ejection head) according to the exemplary embodiments may be applied throughout droplet ejection (spraying) apparatuses that are used in industries, such as making a color filter for display by ejecting ink onto a polymer film or glass, or forming a bump for mounting parts by ejecting a molten solder onto a substrate.

What is claimed is:

1. A droplet ejection head comprising:

a plurality of head members each of which has a nozzle face where a plurality of nozzles for ejecting droplets are formed and an attaching face which is a back side face with respect to the nozzle face, the head members being arranged at a predetermined interval in a longitudinal direction of an elongated substrate by attaching the attachment faces to the elongated substrate;

a plurality of dummy members each of which has a dummy nozzle face and an attaching face which is a back side face with respect to the dummy nozzle face, the dummy members being placed at both end sides of the elongated substrate in the longitudinal direction so that second gaps between the outmost head members and the dummy members are formed;

a sealant that is filled in each of first gaps between the head members and the second gaps, bonds the head members with each other and the dummy members with the outmost head members, and seals the first gaps and the second gaps; and a plurality of elastic members that are disposed in the first gaps and the second gaps, and prevent the sealant from leaking to the attachment face of the head member and the nozzle face from the first gaps and the second gaps before the sealant solidifies.

2. The droplet ejection head of claim 1, wherein each of the first gaps becomes gradually narrower as the position is closer to the nozzle face from the attachment face of the head member, each of the second gaps becomes gradually narrower as the position is closer to the dummy nozzle face from the attachment face of the dummy member, and each of the elastic members disposed in the first gaps is positioned at a predetermined height from the nozzle faces to adjust an interval between the head members at the nozzle faces.

3. The droplet ejection head according to claim 1, wherein each of the elastic members disposed in the second gaps is positioned at the same height as the nozzle face to fill the second gaps at the nozzle surface.

4. The droplet ejection head according to claim 1, wherein each of the elastic members is formed in a hollow-shaped tube, and through-holes are formed on the outer circumferential faces of the hollow-shaped tubes for supplying the sealant, which is sent through the hollow-shaped tube, into the first and second gaps.

5. The droplet ejection head according to claim 1, wherein the first gap at the nozzle face is smaller than the second gap at the nozzle face.

6. A method of manufacturing a droplet ejection head comprising:

disposing elastic members into first gaps between a plurality of head members having nozzle faces where a plurality of nozzles ejecting droplets are formed, and arranged at a predetermined interval in the longitudinal direction of an elongated substrate by attaching attachment faces which are back side faces with respect to the nozzle faces to the elongated substrate;

disposing the elastic members into second gaps between the outmost head members and dummy members placed at both end sides of the elongated substrate in the longitudinal direction of the elongated substrate, by attaching attachment faces which are back side faces with respect to the dummy faces to the elongated substrate; and filling a sealant in the first gaps and the second gaps and hardening the filled sealant to bond the head members with each other and the head member with the dummy member and seal the first gaps and the second gaps.

7. The method according to claim 6, further comprising:

blocking one side of the first gaps and the second gaps in a direction perpendicular to the longitudinal direction with another sealant, before the filling step.

8. The method according to claim 6, further comprising:

cutting the elastic member protruded from the head member and the dummy member, after the filling step.

9. The method according to claim 6, further comprising:

adhering an adhesive tape to the adjacent nozzle surfaces before at least the filling step; and detaching the adhesive tape after the filling step.

* * * * *